US011192620B1

(12) United States Patent
Maresh

(10) Patent No.: US 11,192,620 B1
(45) Date of Patent: Dec. 7, 2021

(54) PROPULSION APPARATUS FOR WATERCRAFT

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 0 days.

(21) Appl. No.: 16/942,759

(22) Filed: Jul. 29, 2020

Related U.S. Application Data

(63) Continuation-in-part of application No. 16/503,260, filed on Jul. 3, 2019.

(60) Provisional application No. 62/922,195, filed on Jul. 29, 2019, provisional application No. 62/763,847, filed on Jul. 3, 2018, provisional application No. 62/764,220, filed on Jul. 23, 2018.

(51) Int. Cl.

| | |
|---|---|
| ***B63H 16/20*** | (2006.01) |
| ***B63H 23/06*** | (2006.01) |
| *B63H 23/02* | (2006.01) |
| *B63H 1/36* | (2006.01) |

(52) U.S. Cl.
CPC ..... *B63H 16/20* (2013.01); *B63H 23/06* (2013.01); *B63H 1/36* (2013.01); *B63H 2016/202* (2013.01); *B63H 2023/025* (2013.01)

(58) Field of Classification Search
CPC .... B63H 1/36; B63H 16/20; B63H 2016/202; B63H 2023/025; B63H 23/06
See application file for complete search history.

(56) References Cited

U.S. PATENT DOCUMENTS

| | | | | |
|---|---|---|---|---|
| 871,059 | A * | 11/1907 | Douse | B63H 1/36 416/81 |
| 1,652,819 | A * | 12/1927 | Dunbar | B63H 23/06 74/63 |
| 9,359,052 | B2 * | 6/2016 | Ketterman | B63H 16/18 |
| 9,475,559 | B2 * | 10/2016 | Czarnowski | B63H 1/36 |
| 9,669,913 | B1 * | 6/2017 | Maresh | B63H 1/32 |
| 10,618,616 | B2 * | 4/2020 | Horrigan | B63H 1/36 |
| 10,926,852 | B2 * | 2/2021 | Kramer | B63H 16/18 |

FOREIGN PATENT DOCUMENTS

| | | | | |
|---|---|---|---|---|
| DE | 2843036 | A1 * | 4/1980 | B63H 1/36 |

* cited by examiner

*Primary Examiner* — Andrew Polay
(74) *Attorney, Agent, or Firm* — Nick A Nichols, Jr.

(57) ABSTRACT

A watercraft propulsion apparatus includes an eccentric crank assembly operatively connected to a pair of fins adapted to sweep back and forth in a generally transverse direction relative to a longitudinal axis of the watercraft. The fins may be rotatable about a longitudinal shaft fixedly secure to the bottom of the hull of the watercraft. A drive linkage assembly operatively connecting the eccentric crank assembly to the pair of fins imparts a torque force to oscillate the pair of fins. The oscillating fins provide a propulsive force to propel the watercraft longitudinally forward during both oscillating directions of the fins as they sweep back and forth.

6 Claims, 13 Drawing Sheets

PROPULSION APPARATUS FOR WATERCRAFT

CROSS-REFERENCE TO RELATED APPLICATION

This application claims priority to and the benefit of the filing date of U.S. Provisional Application Ser. No. 62/922,195, filed Jul. 29, 2019, and is a continuation-in-part of U.S. Nonprovisional application Ser. No. 16/503,260, filed Jul. 3, 2019, which claims benefit of the filing date of U.S. Provisional Application No. 62/763,847, filed Jul. 3, 2018, and U.S. Provisional Application No. 62/764,220, filed Jul. 23, 2018, which applications are herein incorporated by reference in their entirety.

BACKGROUND

The present invention relates to watercraft propulsion, particularly, oscillating fin propulsion.

Pedal operated propulsion apparatus, such as a foot operated p addle boat described in U.S. Pat. No. 3,095,850, are known in the art. Other pedal operated means linking rotatable pedals to a propeller have been proposed. Some have looked to the swimming motion of sea creatures to design mechanically powered propulsion systems. Generally speaking, the swimming behavior of sea creatures may be classified into two distinct modes of motion: middle fin motion or median and paired fin (MPF) mode and tail fin or body and-caudal fin (BCF) mode, based upon the body structures involved in thrust production. Within each of these classifications, there are numerous swimming modes along a spectrum of behaviors from purely undulatory to entirely oscillatory modes. In undulatory swimming modes thrust is produced by wave-like movements of the propulsive structure (usually a fin or the whole body). Oscillatory modes, on the other hand, are characterized by thrust production from a swiveling of the propulsive structure at the attachment point without any wave-like motion. A penguin or a turtle, for example, may be considered to have movements generally consistent with an oscillatory mode of propulsion.

In 1997, Massachusetts Institute of Technology (MIT) researchers reported that a propulsion system that utilized two oscillating blades of MPF mode produced thrust by sweeping back and forth in opposite directions had achieved efficiencies of 87%, compared to 70% efficiencies for conventional watercraft. A 12-foot scale model of the MIT Proteus "penguin boat" was capable of moving as fast as conventional propeller driven watercraft. Another MIT propulsion system referred to as a "Robotuna," utilized a tail in BCF mode propulsion patterned after a blue fin tuna, achieved efficiencies of 85%. Based upon limited studies, higher efficiencies of 87% (and by some reports 90-95% efficiency) may be possible with oscillatory MPF mode propulsion that may enable relatively long distances of human powered propulsion being achieved both on and under the water surface.

SUMMARY

A watercraft propulsion apparatus includes an eccentric crank assembly operatively connected to a pair of fins adapted to sweep back and forth in a generally transverse direction relative to a longitudinal axis of the watercraft. The fins may be rotatable about a longitudinal shaft to the bottom of the hull of the watercraft. A drive linkage assembly operatively connecting the eccentric crank assembly to the pair of fins imparts a torque force to oscillate the pair of fins. The oscillating fins provide a propulsive force to propel the watercraft longitudinally forward during both oscillating directions of the fins as they sweep back and forth.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
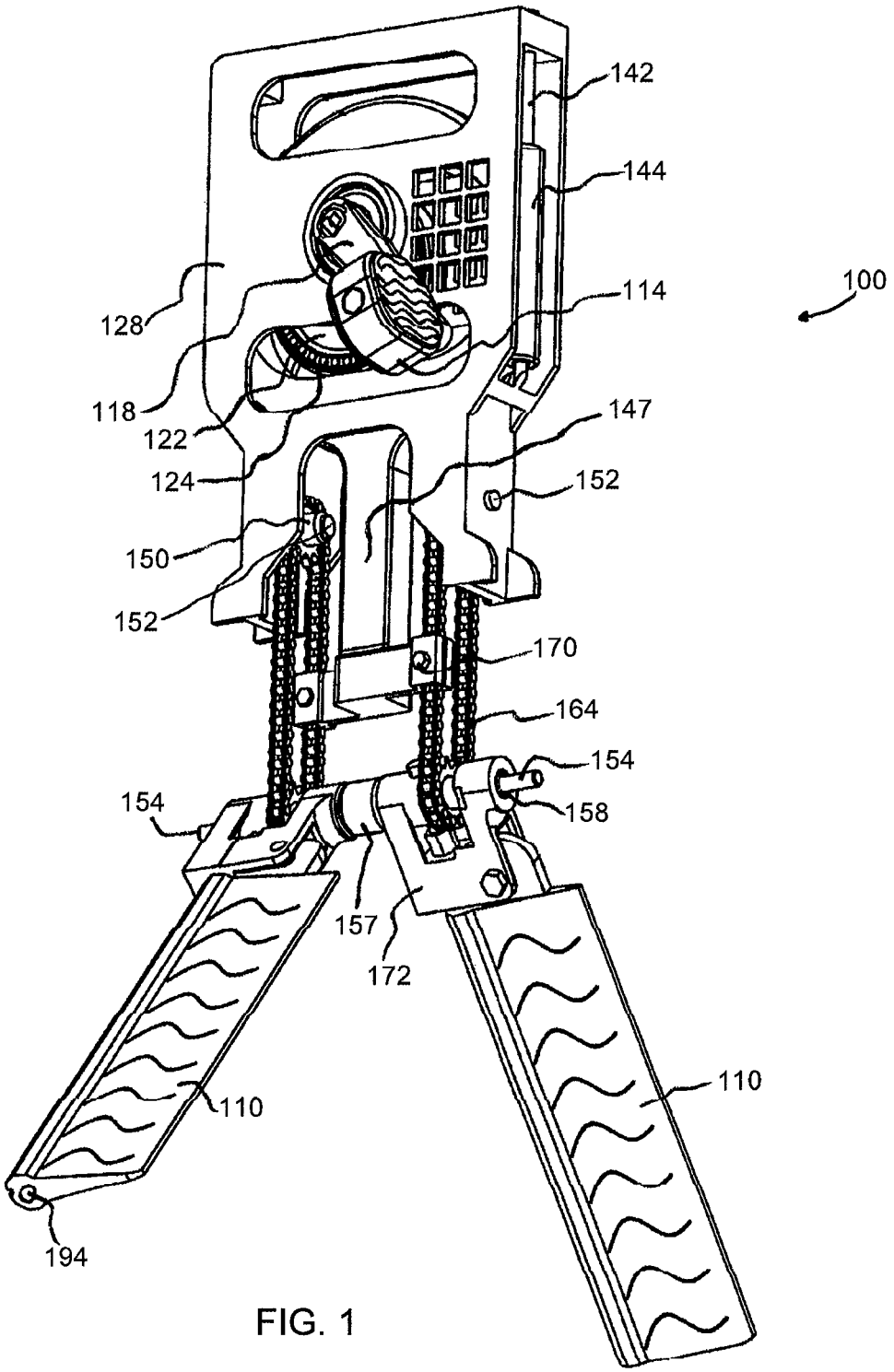
FIG. 1 is a perspective view of a watercraft propulsion apparatus.

Referring first to FIG. 1, a watercraft propulsion apparatus is generally identified by the reference numeral 100. A watercraft, for example but without limitation, such as a kayak, canoe, paddle board and the like, may be propelled by the propulsion apparatus 100. The watercraft may include a hull and a passageway or opening through the bottom of the hull. The propulsion apparatus 100 may be fixedly secured to a bottom surface within the hull. A pair of flexible fins 110 may extend through the hull opening into the water below the water surface. The interface of the propulsion apparatus 100 with the watercraft hull may be sealed in a known manner to prevent entry of water into the watercraft.

Figure 2:
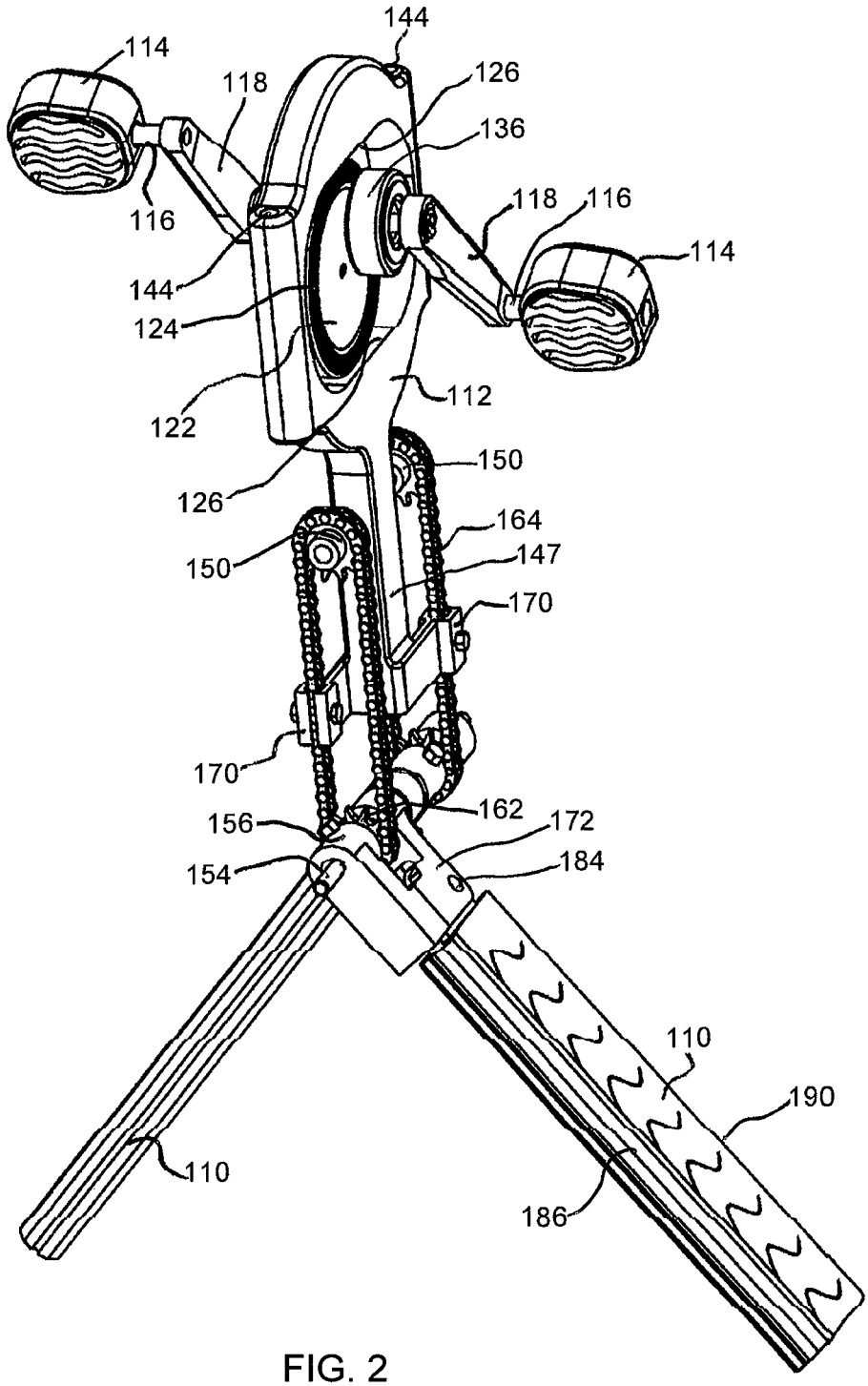
FIG. 2 is a perspective view of the propulsion apparatus shown in FIG. 1 with the cover removed.
Figure 3:
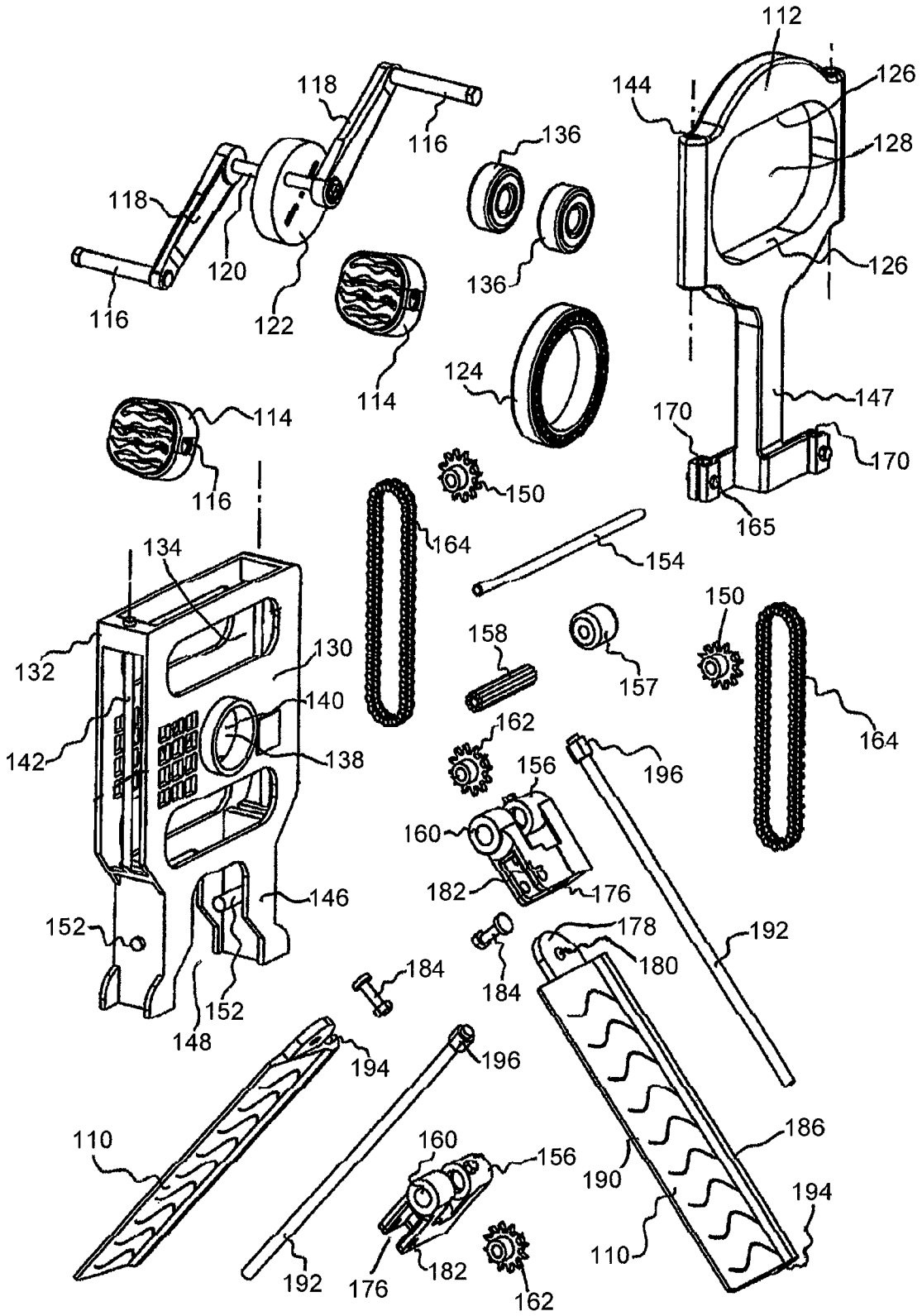
FIG. 3 is an exploded view showing the parts of the propulsion apparatus shown in FIG. 1.
Figure 4A:
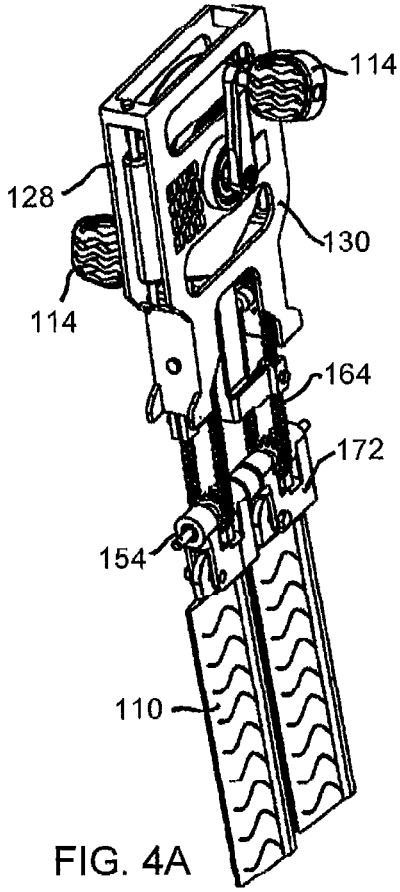
FIGS. 4A-4D are perspective views of the propulsion apparatus shown in FIG. 1 illustrating the position of the foot pedals and fins during pedaling.
Figure 4B:
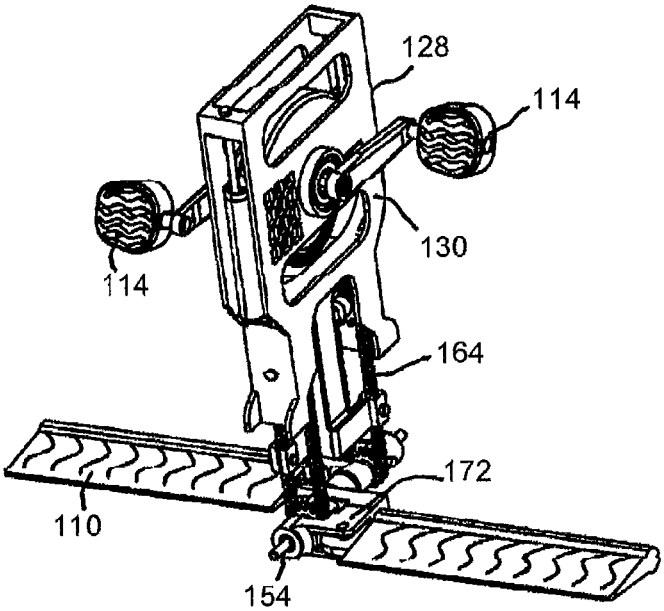
Figure 4D:
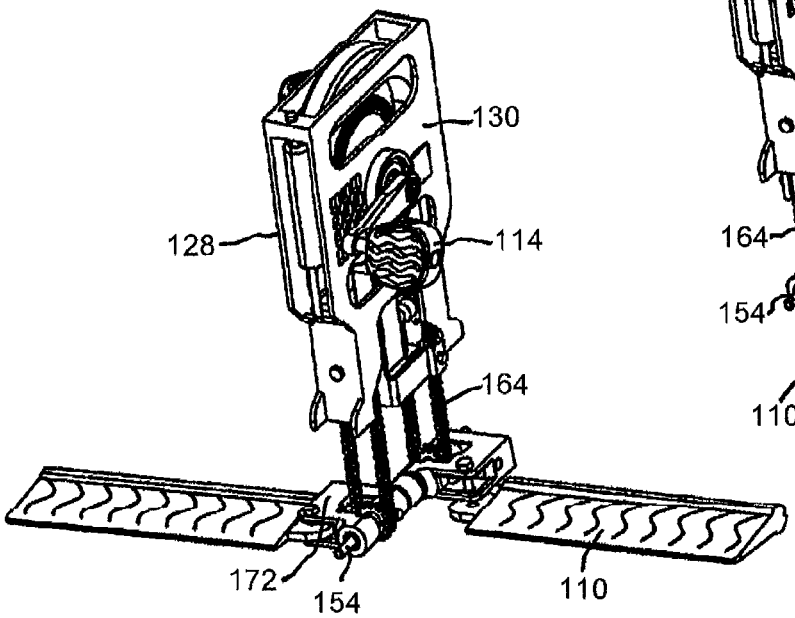
Figure 4C:
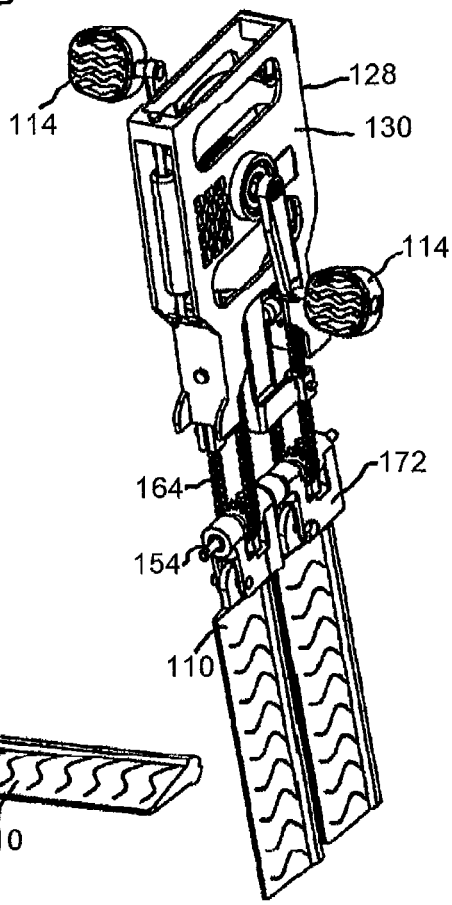
Figure 5:
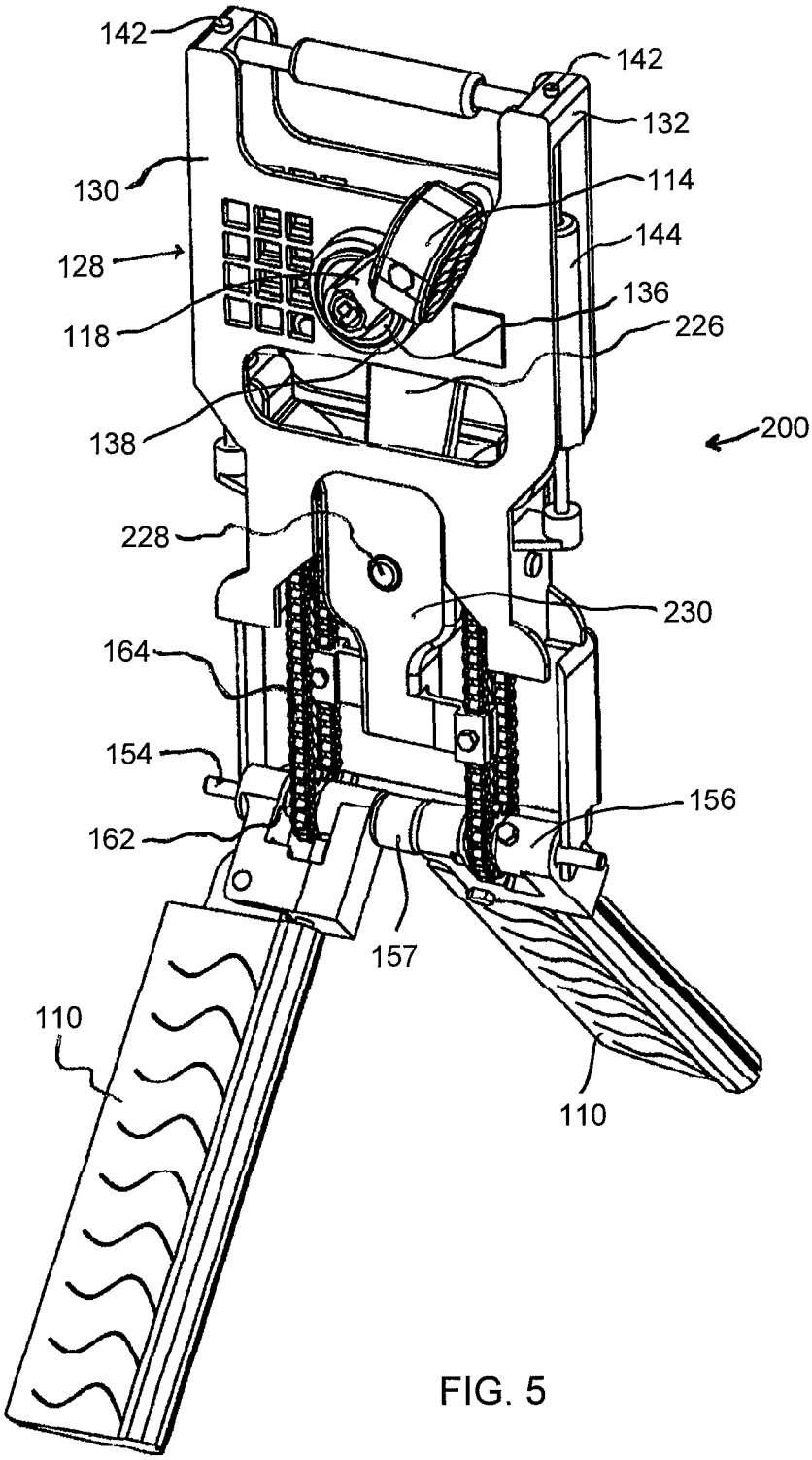
FIG. 5 is a perspective view of a second embodiment of a watercraft propulsion apparatus.
Figure 6:
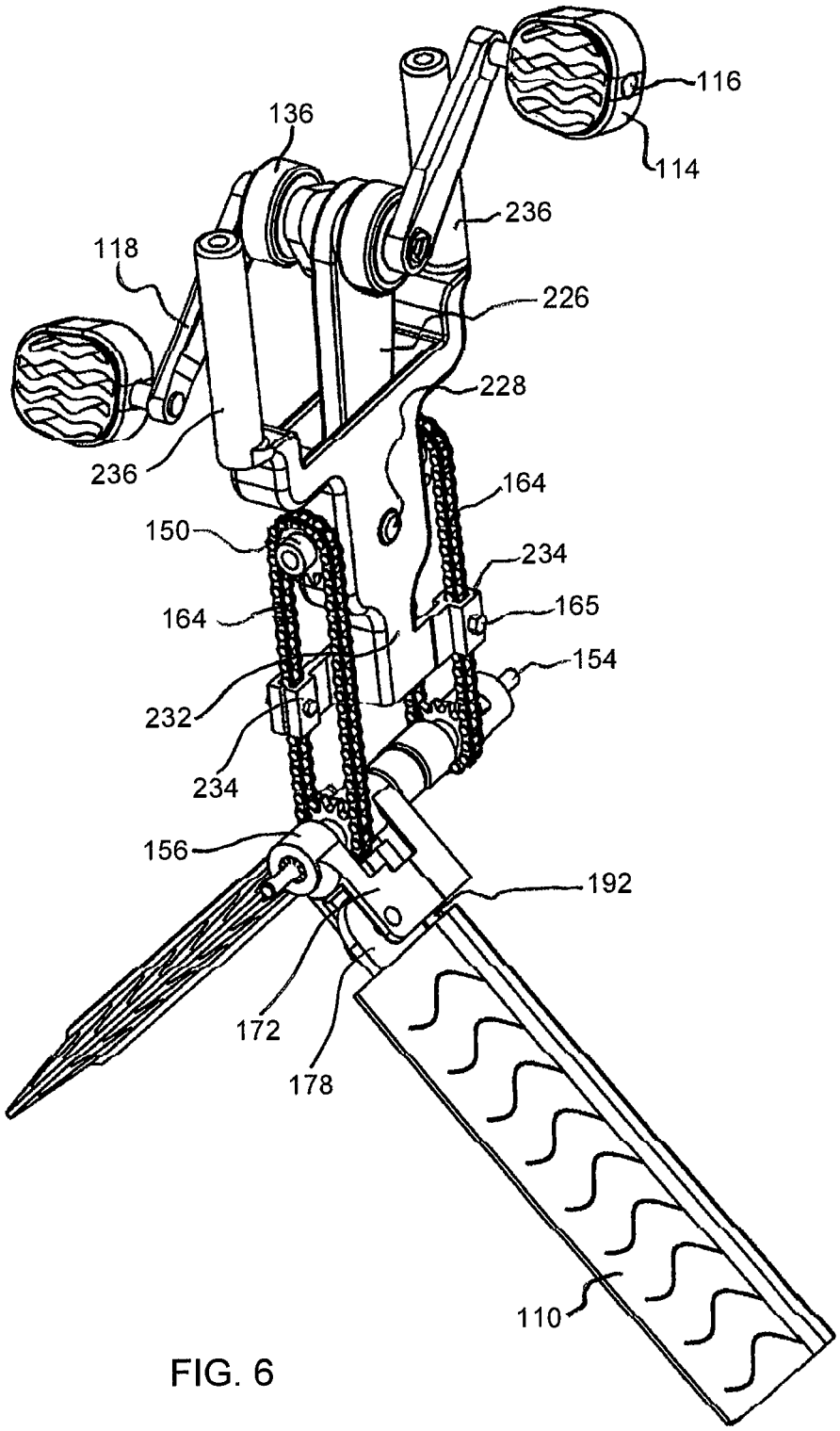
FIG. 6 is a perspective of the propulsion apparatus shown in FIG. 5 with parts removed.
Figure 7:
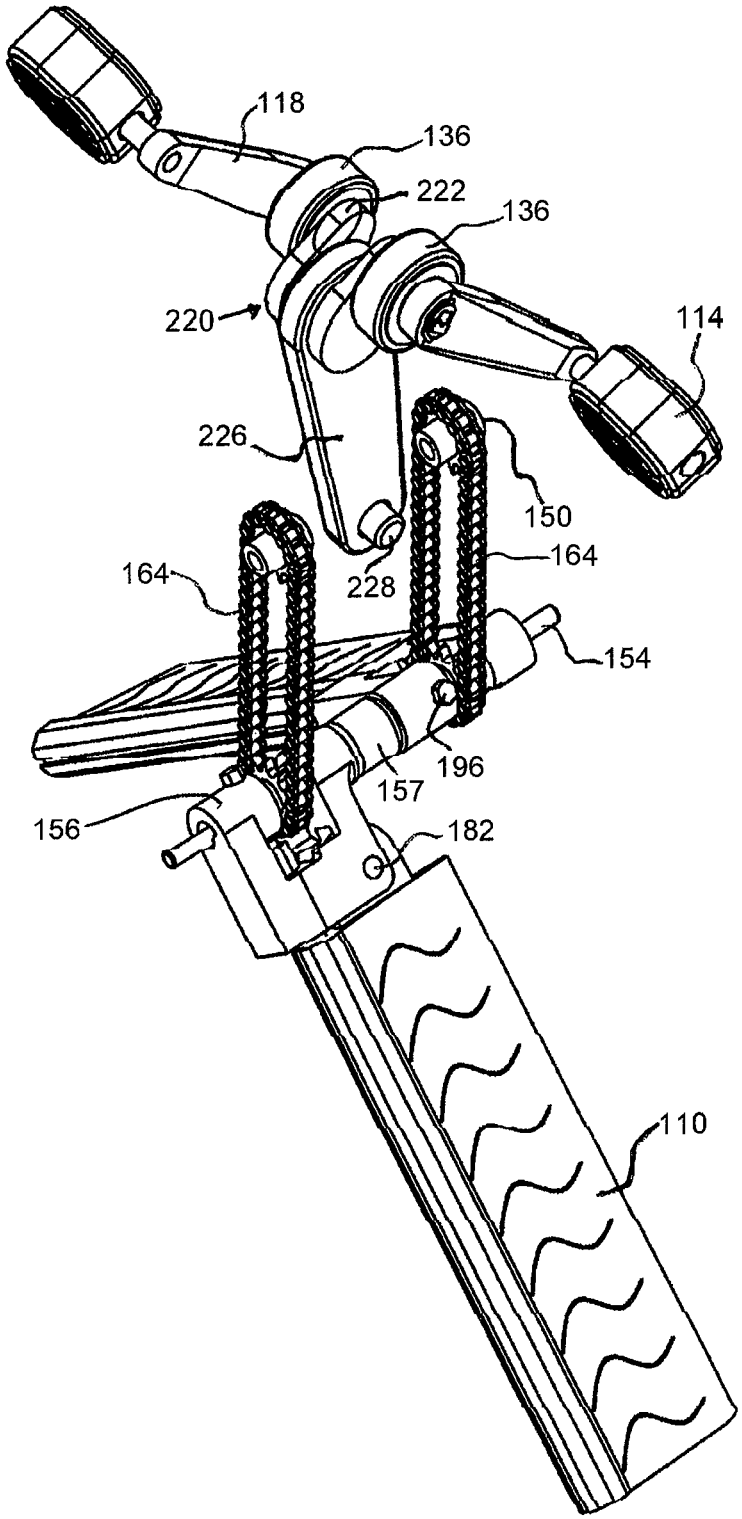
FIG. 7 is an exploded view of the propulsion apparatus shown in FIG. 5 with parts removed.
Figure 8:
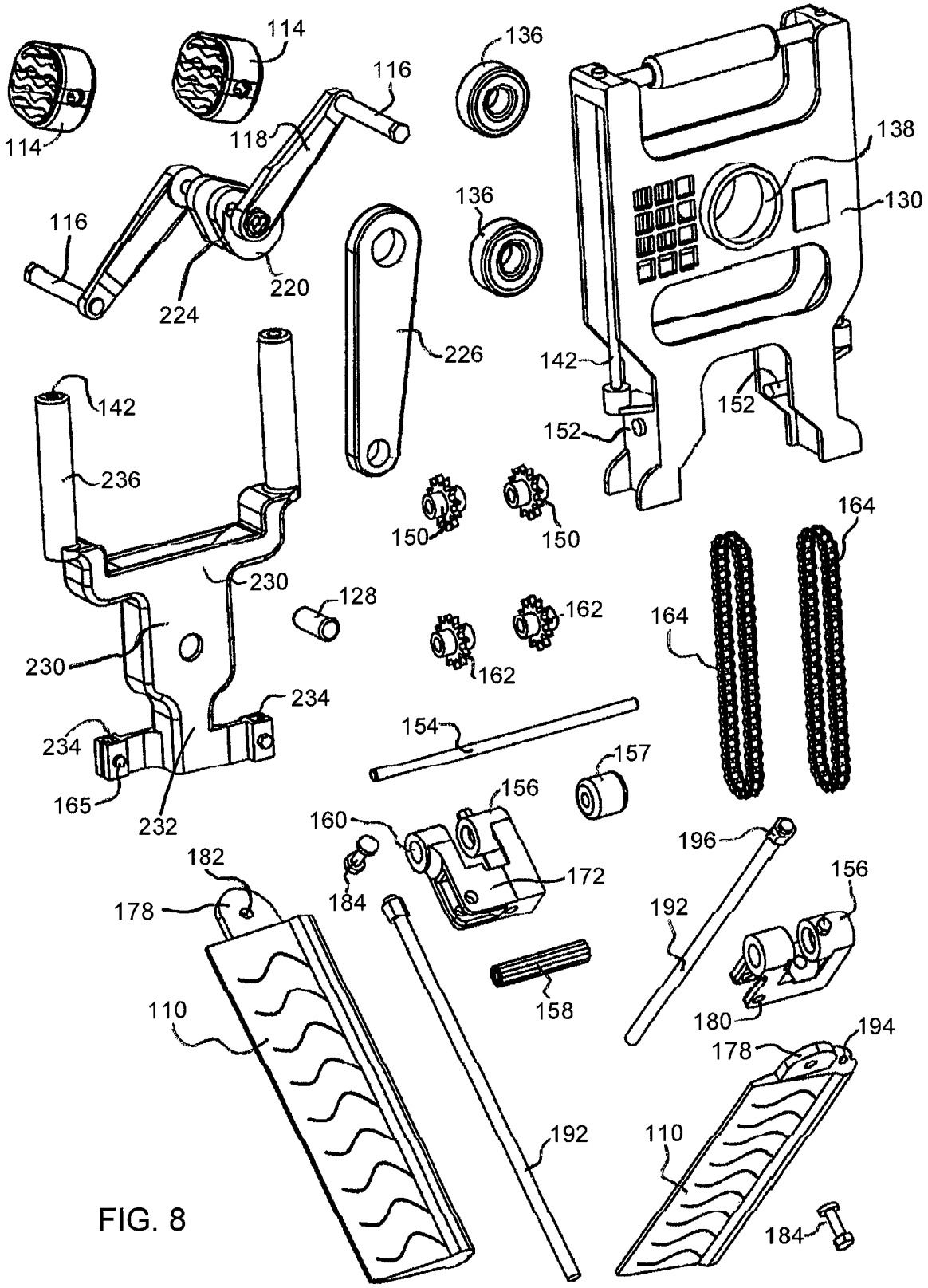
FIG. 8 is an exploded view showing the parts of the propulsion apparatus shown in FIG. 5.
Figure 9:
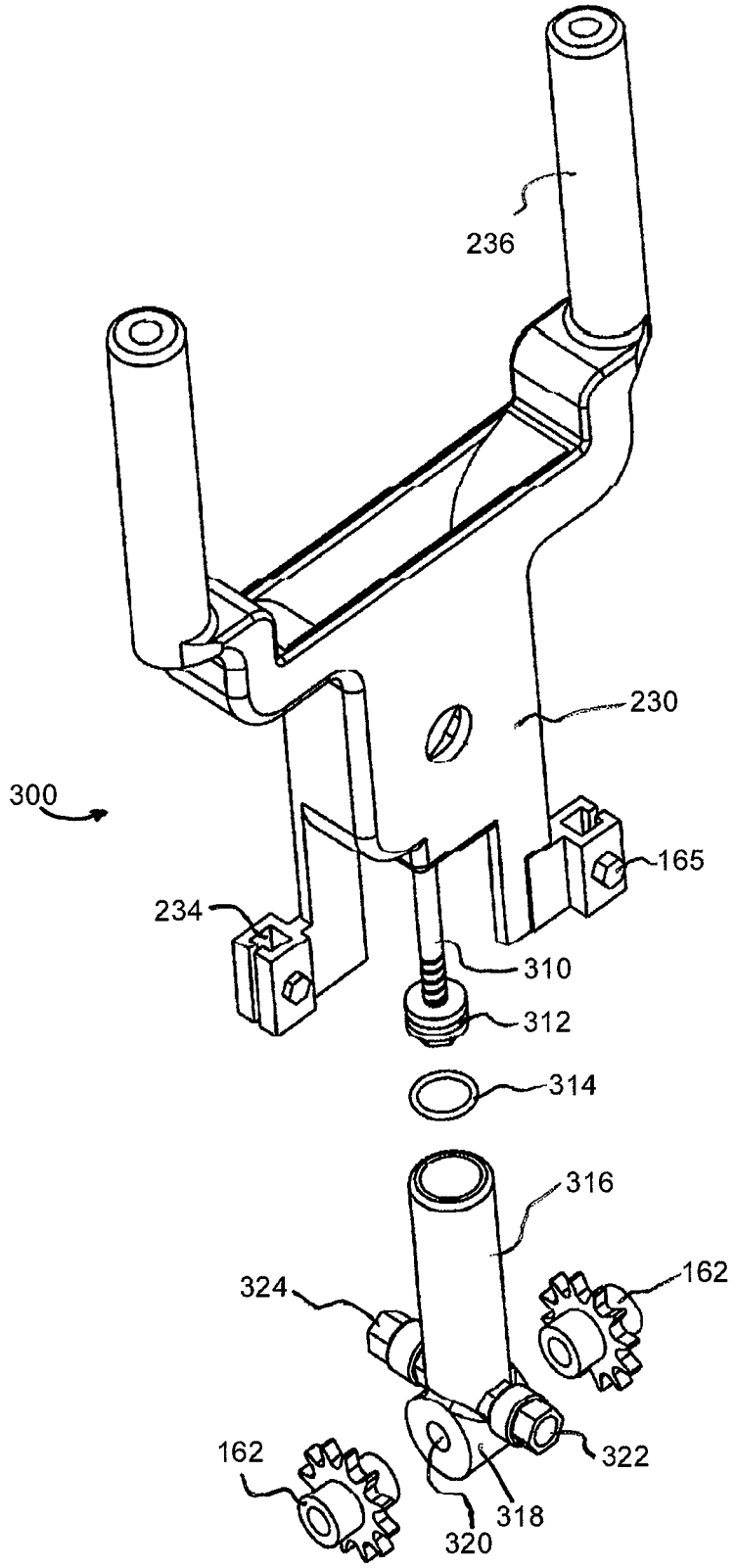
FIG. 9 is an exploded perspective view of a third embodiment of a watercraft propulsion apparatus with parts removed.
Figure 10A:
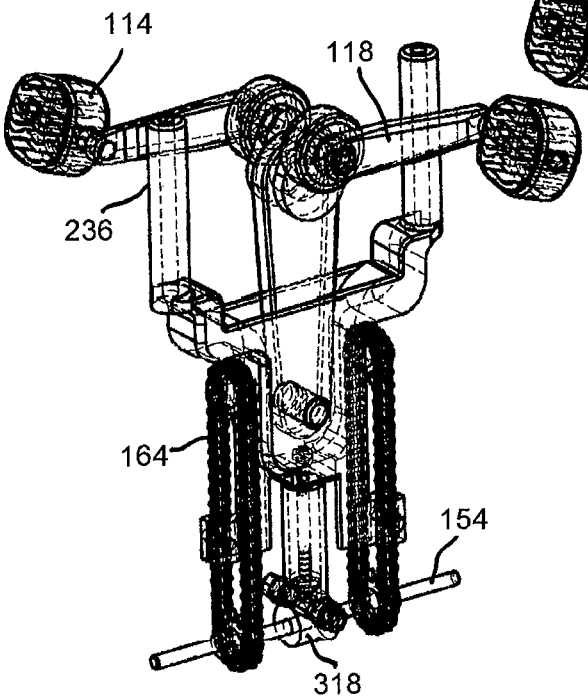
FIGS. 10A-10D are perspective views of the propulsion apparatus shown in FIG. 9 illustrating the position of the foot pedals and operation of a bilge pump during pedaling.
Figure 10B:
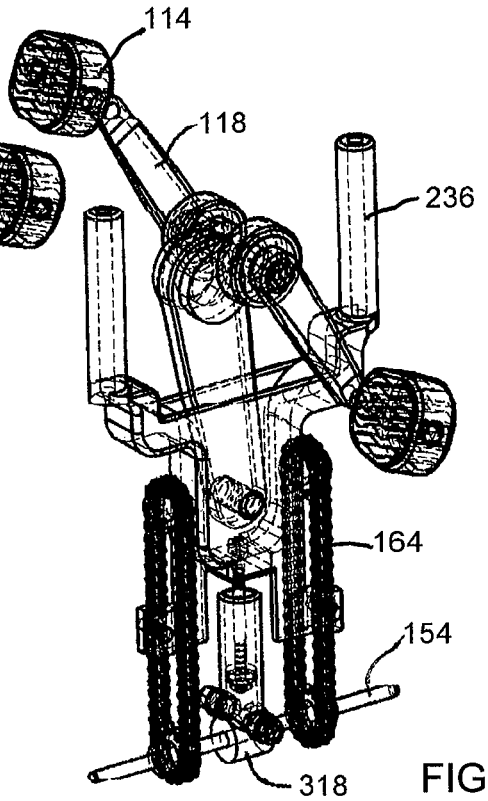
Figure 10D:
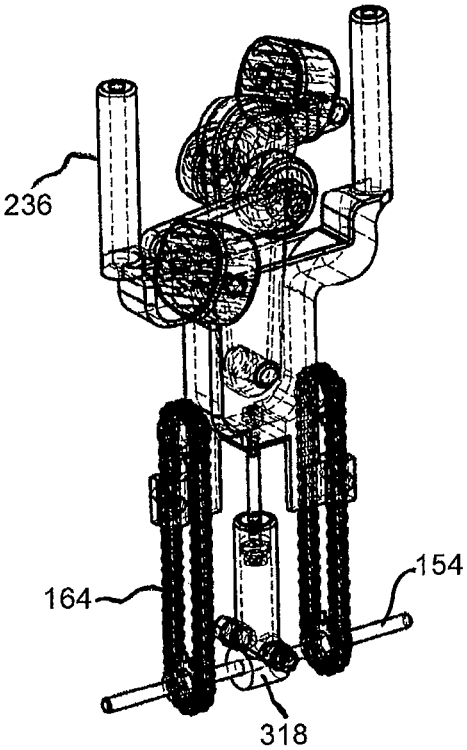
Figure 10C:
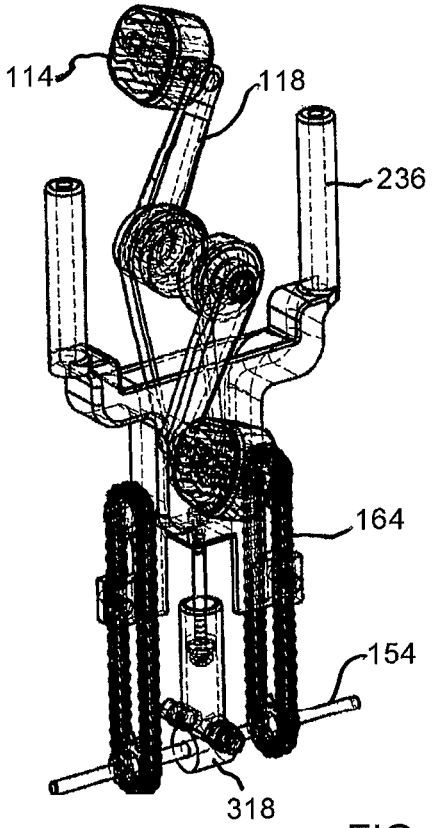

Referring now to FIG. 2, the propulsion apparatus 100 may include a piston block 112 adapted for linear reciprocation. Foot pedals 114 may be rotatably secured about bearing shafts 116 which are fixedly secured to crank arms 118. The crank arms 118 may be connected to the crank shafts 120 which are fixedly secured to opposite sides of an eccentric crank disc 122. The crank shafts 120 may be laterally offset from the center of the eccentric crank disc 122. Optionally, bearing 124 may be secured about the eccentric crank disc 122.

The piston block 112 may include relatively flat generally horizontal upper and lower race regions 126 circumventing an opening 128 in the piston block 112. Moving the foot pedals 114 through a cycling motion reciprocates the piston block 112 in an upward and downward generally vertical motion as the foot pedals 114 rotate about the axis of the crank shafts 120. Typically, only a few thousandths of an inch clearance (or fit to fit) may be provided between the outside diameter of the bearing 124 and the upper and lower race regions 126 of the piston block 112, such that oscillatory reversal vibrations of the bearing 124 may be minimized as the piston block 112 is raised and lowered through a cycling motion. The piston block 112 may be constructed of nonmetallic material, such as but without limitation, UHMW plastic material, to further minimize vibration noise.

The piston block 112 may be secured in a shroud or housing 128 which may include sidewalls 130 and partially open end walls 132 an enclosure 134. Bearings 136 may be journaled about crank shafts 120. Bearings 136 may be fitted in bearing housings 138 in the openings 140 of the shroud sidewalls 130. The piston block 112 may be linearly constrained to move along guideposts 142 fixedly secured at opposite sides of the shroud 128. The guideposts 142, for example but without limitation, may be fabricated of polished metal.

The piston block 112 may include longitudinal boreholes 144 along the sides thereof. Upon assembly with the shroud 128, the guideposts 142 may extend through respective boreholes 144 slidably securing the piston block 112 to the shroud 128 such that the piston block 112 may reciprocally travel generally vertically relative to the shroud 128.

The shroud 128 may include downwardly extending leg members 146 which are spaced apart relative to one another and define a gap 148 therebetween. Upper sprockets 150 may be rotatably secured to respective the leg members 146 at bearing shafts 152. The piston block 112 may include a downwardly extending piston rod 147 extending through the gap 148 between the leg members 146 of the shroud 128.

A main shaft 154 may be fixedly secured to the watercraft generally below the waterline. Fin connectors 156 may be rotatably secured to the main shaft 154. The fin connectors 156 may include boreholes 160 for receiving the main shaft 154 therethrough. The longitudinal axis of the boreholes 160 may be coincident with the longitudinal axis of the main shaft 154. Needle bearings 158 may be optionally disposed between the main shaft 154 and boreholes 160. Typically, the needle bearings 158 may be constructed of a polymer, such as Delrin, polypropylene, or Peek, for example but without limitation. Similarly, bearing 124 may include ball rollers or needle bearing. Lower sprockets 162 may be fixedly secured to the fin connectors 156.

Endless roller chains 164 may be routed about upper sprockets 150 and lower sprockets 162. Roller chain clamps 170 may be fixedly secured proximate a lower distal end 168 of the piston rod 147. The roller chain clamps 170 may extend generally horizontally outwardly from the piston rod 147 in opposite directions. The roller chain clamps 170 may be secured to front and rear segments of respective roller chains 164 with clamp bolts 165 and the like.

Fin clews 172 fixed to the fin connectors 156 may secure the fins 110 to the fin connectors 156. The fin clews 172 may define a slot or cavity 176 for receiving a fin tab 178 projecting from the base of the fins 110. The fin tab 178 and the fin clews 172 may include through holes 180 and 182, respectively, which upon alignment may receive clew bolt 184 securing the fins 110 to the fin connectors 156. A spacer 157 may be journaled about the main shaft 154 to maintain proper spacing between the fin connectors 156 and the fins 110.

The fins 110 may comprise a substantially flat body that is thicker along a generally rigid leading edge 186 and a generally flexible region 188. The thickness of the fins 110 may gradually decrease from the leading edge 186 to a trailing edge 190. The stiffness or rigidity of the fins 110 is generally greater at the leading edge 186 and decreases toward the trailing edge 190. Combinations of different materials in the manufacture of the fins 110 or other manufacturing means may alter the stiffness characteristics of the fins 110.

A mast 192 may be received in an elongated borehole 194 in the leading edge 186 of the fins 110. A hex nut 196 or other suitable connector may secure the mast 192 to the fin clew 172. The fins 110 may re-orientate a limited amount, back and forth, while oscillating to create an optimum angle of attack against the water in a manner known in the art. The fin clews 172 may limit the angle of attack of the oscillating fins 110, typically not more than plus or minus thirty degrees (+/−30°) of oscillation. Other clew means may be employed as known in the art. Alternatively, the upper region of the fins 110 may be rigidly secured to the fin connectors 156.

During operation of the propulsion apparatus 100, a user may apply a cycling motion to the foot pedals 114 to rotate the eccentric disc 122 and move the piston block 112 and piston rod 147 in a generally vertical reciprocal motion thereby oscillating the fins 110 and propelling the watercraft forward.

Referring now to FIGS. 5-8, a second embodiment of a watercraft propulsion apparatus is generally identified by the reference numeral 200. As indicated by the use of common reference numerals, the propulsion apparatus 200 is similar to the propulsion apparatus 100 described above. The propulsion apparatus 200 may include foot pedals 114 rotatably secured to crank arms 118. The crank arms 118 may be fixedly connected to an eccentric crank 220. The eccentric crank 220 may include distal ends 222 connected to the crank arms 118 and a central region 224 that is laterally offset from the longitudinal axis AA defined by the distal ends 222. The eccentric crank 220 may be rotatably secured to the shroud 128. Bearings 136 may be journaled about distal ends of the eccentric crank 220. The bearings 136 may be fitted in bearing housings 138 in the openings 140 of the shroud sidewalls 130. An upper distal end of a piston rod 226 may be rotatably secured to the laterally offset central region 224 of the eccentric crank 220.

A lower distal end of the piston rod 226 may be rotatably secured to a wrist pin 228 that is secured to a piston block 230. The piston block 230 may be linearly constrained to move along guideposts 142 fixedly secured at opposite sides of the shroud 128. The guideposts 142, for example but without limitation, may be fabricated of polished metal. The piston block 230 may be constructed of metal, or nonmetallic/polymer materials, such as but without limitation, UHMW and the like.

The piston block 230 may include an extension 232 which supports a pair of roller chain clamps 234. The roller chain clamps 234 may extend generally horizontally outwardly from the piston block extension 232 in opposite directions. The roller chain clamps 234 may be secured to front and rear segments of respective roller chains 164 with clamp bolts 165 and the like. The roller chains 164 may be routed about the sprockets 150, 162, described in greater detail hereinabove.

The piston block 230 may include tubular members 236 extending upwardly from the piston block 230. Upon assembly with the shroud 128, the guideposts 142 fixedly secured to opposite sides of the shroud 128 may extend through respective tubular members 236 slidably securing the piston block 230 to the shroud 128. The piston block 230 may be linearly constrained to reciprocally travel along the guideposts 142 generally vertically relative to the shroud 128.

Referring now to FIG. 9 and FIGS. 10A-10D, a third embodiment of a watercraft propulsion apparatus is generally identified by the reference numeral 300. As indicated by the use of common reference numerals, the propulsion apparatus 300 is similar to the propulsion apparatus 200 described above with exception that the propulsion apparatus 300 includes a bilge pump system operable by the reciprocating linear motion of the piston block 230. The bilge pump may operate continuously whether or not watercraft flooding is occurring. The bilge pump may include piston "O" rings, and "IN" and "OUT" check valves that effectively removes excess water out of the watercraft. The propulsion apparatus 300 may include a bilge piston rod 310 rigidly secured to the piston block 230. The bilge piston rod 310 may extend downwardly from the piston block 230. A bilge piston 312 may be fixedly secured to the lower distal end of the bilge piston rod 310. An "O" ring 314 or other suitable sliding seal may be fitted about the bilge piston 312 to provide a watertight seal between the bilge piston 312 and a bilge cylinder 316. The bilge pump cylinder 316 may be secured to the main shaft 154 and extend generally vertically. The lower portion of the bilge pump cylinder 316 may include a journal 318 having a generally horizontal borehole 320 for receiving the main shaft 154 therethrough. The bilge pump may include check valves 322 and 324 in fluid communication with the bilge cylinder 316. An unillustrated first hose or tube may be connected to the "IN" port of the bilge cylinder 316 and a second hose or tube may be connected to the "OUT" port of the cylinder 316. The opposite open end of the first hose may be secured in a lower internal region of the watercraft where water may collect. The opposite open end of the second hose may be secured at a point outside the watercraft.

Negligible energy may be lost during the continuous pumping/cycling action of the bilge pump. However, if water enters the hull of the watercraft the upward movement of the bilge piston 312 within the pump cylinder 316 sucks water through the "IN" port and as the bilge piston 312 moves downward into the pump cylinder 316, water is discharge out through the "OUT" port. The check valves 322, 324 may be configured to cooperatively permit water to enter the pump cylinder 316 on the upstroke to the bilge piston 312 and discharge water on the downstroke. In an alternate unillustrated embodiment, bellows may be employed instead of the bilge cylinder to take advantage of the linear reciprocation of the piston block 230.

Figure 11:
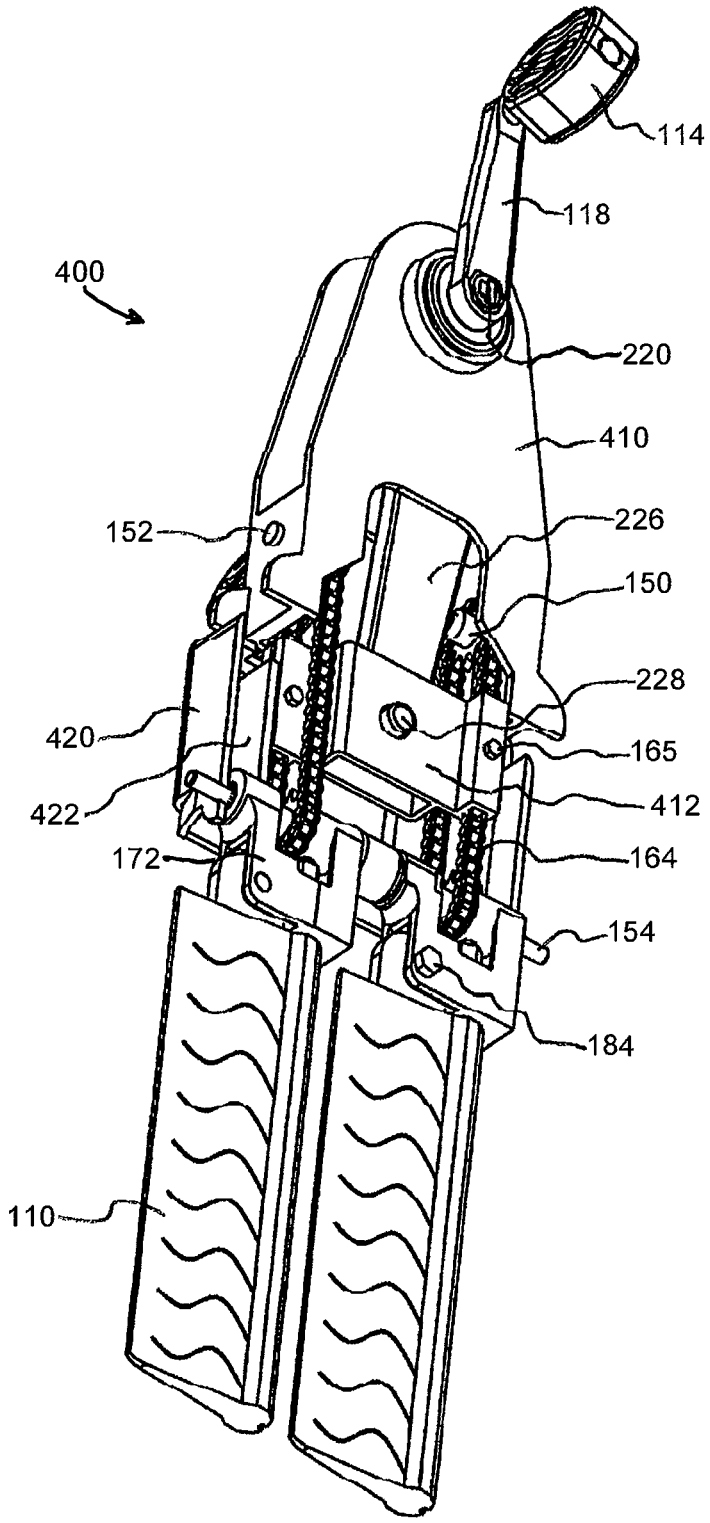
FIG. 11 is a perspective view of a fourth embodiment of a watercraft propulsion apparatus.
Figure 12:
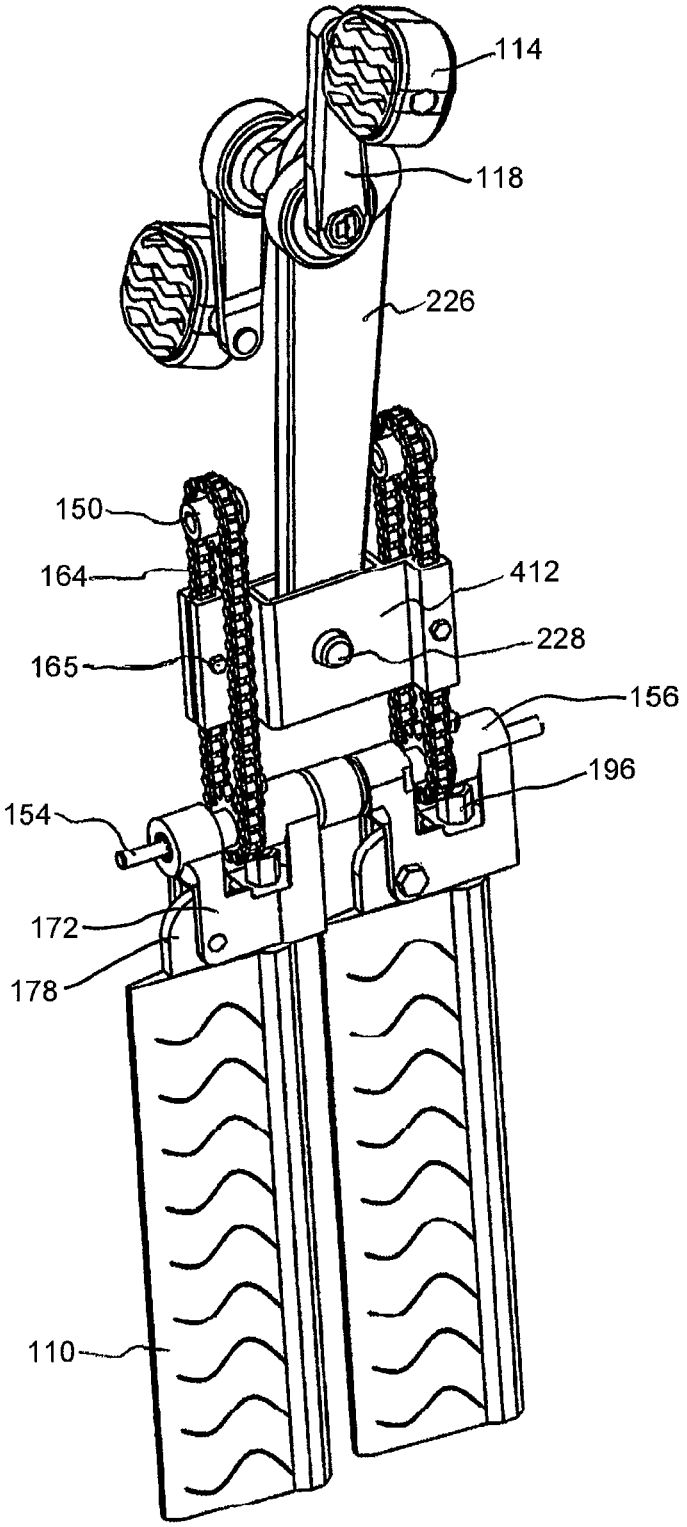
FIG. 12 is a perspective view of the propulsion apparatus shown in FIG. 11 with parts removed.
Figure 13:
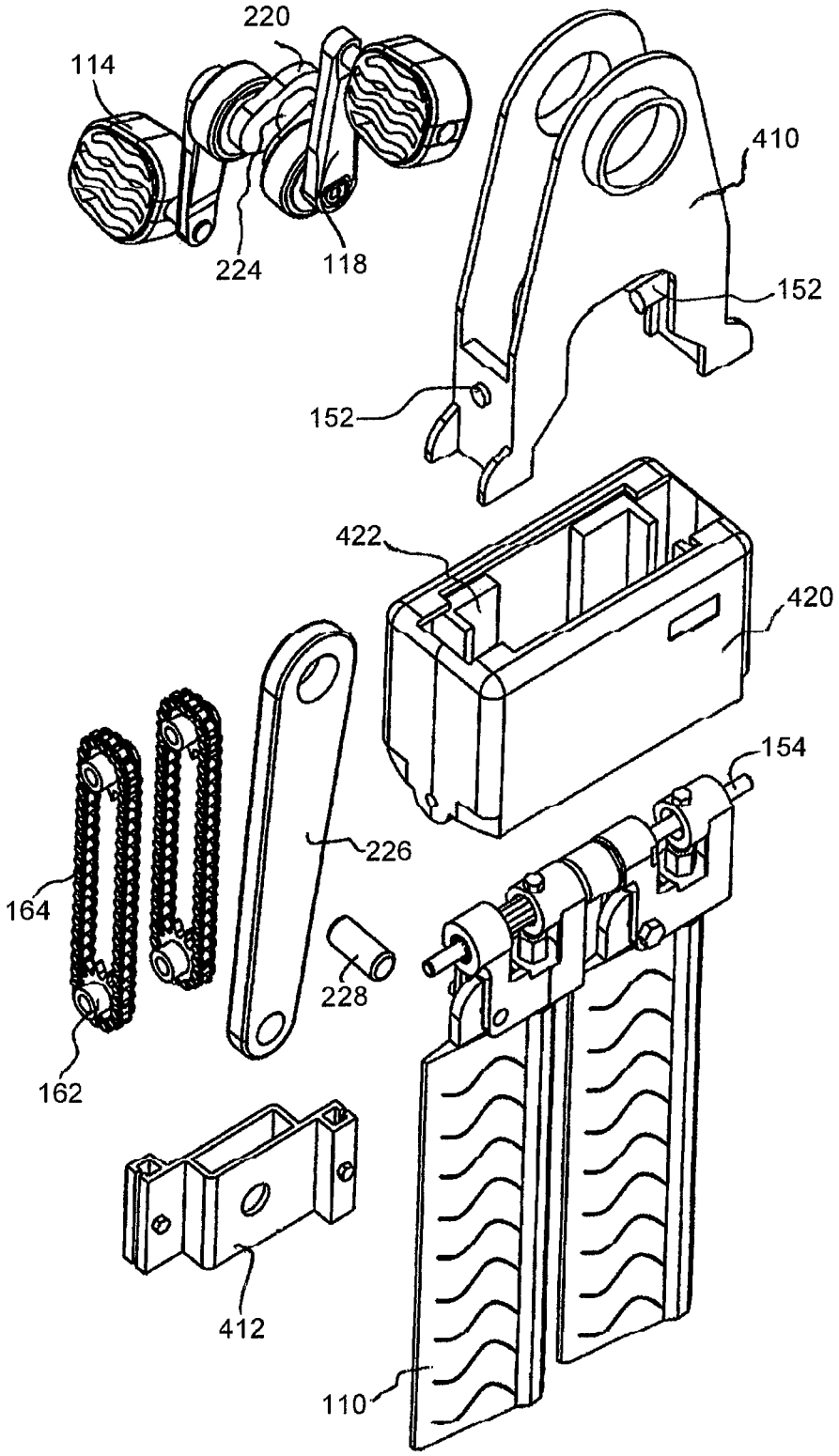
FIG. 13 is an exploded perspective view showing the parts of the propulsion apparatus shown in FIG. 11.

Referring now to FIGS. 11-13, a fourth embodiment of a watercraft propulsion apparatus is generally identified by the reference numeral 400. As indicated by the use of common reference numerals, the propulsion apparatus 400 is similar to the propulsion apparatus 200 described above. The propulsion apparatus 400 may include foot pedals 114 rotatably secured to crank arms 118. The crank arms 118 may be fixedly connected to an eccentric crank 220. The eccentric crank 220 may be rotatably secured to the shroud 410. An upper distal end of a piston rod 226 may be rotatably secured to the eccentric crank 220.

A lower distal end of the piston rod 226 may be rotatably secured to the wrist pin 228 that is secured to a chain yoke 412. The chain yoke 412 may be sufficiently linearly constrained upon clamping the chain yoke 412 to opposite side spans of the roller chains 164. In this manner, as the chain yoke 412 reciprocates up and down, the front set of sprockets 150, 162 counter rotate relative to the rear set of sprockets 150, 162, consequently causing counter oscillation of the fins 110 as eccentric crank 220 is rotated.

Continuing with the propulsion apparatus 400, a guide frame 420 may be removably secured to the shroud 128. The guide frame 420 may optionally include low friction slide races 422 to provide for additional linear constraint for the chain yoke 412. As with any of the watercraft propulsion apparatus illustrated herein, a bilge pump system may be included to take advantage of the reciprocating movement of the piston blocks.

While preferred embodiments of the invention have been shown and described, other and further embodiments of the invention may be devised without departing from the basic scope thereof, and the scope thereof is determined by the claims which follow.

The invention claimed is:

1. A watercraft propulsion apparatus, comprising:

a) a propulsion assembly fixedly secure to the watercraft;

b) said propulsion assembly including:

i) a housing;

ii) a piston block movably supported by said housing, said piston block including an opening;

iii) an eccentric crank rotationally supported by said housing within said opening of said piston block; and iv) a pair of fins operatively connected to said piston block, wherein rotational movement of said eccentric crank imparts a force to oscillate said pair of fins transversely to a center longitudinal axis of the watercraft.

2. The propulsion apparatus of claim 1 wherein said piston block includes a downwardly extending piston rod, said piston rod including a pair of oppositely extending clamps proximate a distal end of said piston rod.

3. The propulsion apparatus of claim 2 including a longitudinal shaft fixedly secure to a bottom surface of the watercraft, and further including a pair of fin connectors rotationally secured to said longitudinal shaft.

4. The propulsion apparatus of claim 3 including a pair of upper sprockets movably supported by said housing, said pair of sprockets in spaced relationship to one another, and further including a pair of lower sprockets fixedly connected to a respective said pair of fin connectors.

5. The propulsion apparatus of claim 4 including a pair of roller chains routed about said upper and lower sprockets, said clamps coupled to respective said pair of roller chains.

6. The propulsion apparatus of claim 1 including foot pedals operatively connected to said eccentric crank, wherein a cycling motion imparts a reciprocating motion of said piston block to oscillate said pair of fins.

* * * * *